US006774554B1

(12) United States Patent
Kojima et al.

(10) Patent No.: US 6,774,554 B1
(45) Date of Patent: Aug. 10, 2004

(54) CATHODE RAY TUBE

(75) Inventors: Toshikuni Kojima, Kyoto (JP); Masanori Morii, Osaka (JP); Hiromi Wakasono, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 206 days.

(21) Appl. No.: 09/645,741

(22) Filed: Aug. 24, 2000

(30) Foreign Application Priority Data

Sep. 21, 1999 (JP) ..... 11-266814

(51) Int. Cl.[7] ..... H01J 29/88

(52) U.S. Cl. ..... 313/479; 313/477 R; 313/477 HC; 313/450; 313/409; 313/414

(58) Field of Search ..... 313/477 R, 479, 313/450, 409, 477 HC, 414

(56) References Cited

U.S. PATENT DOCUMENTS

| | | | | | |
|---|---|---|---|---|---|
| 4,018,717 | A | * | 4/1977 | Francel et al. | 106/1.12 |
| 4,124,540 | A | * | 11/1978 | Foreman et al. | 252/519.32 |
| 4,473,774 | A | * | 9/1984 | Hernqvist | 313/479 |
| 4,518,893 | A | * | 5/1985 | Kane et al. | 313/479 |
| 4,527,229 | A | * | 7/1985 | Imamura et al. | 315/411 |
| 4,571,521 | A | * | 2/1986 | Gallaro et al. | 313/402 |
| 4,602,187 | A | * | 7/1986 | Fischman et al. | 313/477 HC |
| 4,713,879 | A | * | 12/1987 | Vrijssen | 29/620 |
| 4,827,184 | A | * | 5/1989 | Spanjer et al. | 313/432 |
| 4,980,606 | A | * | 12/1990 | Yamauchi et al. | 315/14 |
| 5,220,242 | A | * | 6/1993 | Choi | 313/450 |
| 5,539,278 | A | * | 7/1996 | Takahashi | 313/414 |
| 5,985,067 | A | * | 11/1999 | Schmid et al. | 156/230 |
| 6,229,256 | B1 | * | 5/2001 | Suzuki et al. | 313/450 |

FOREIGN PATENT DOCUMENTS

| | | | | |
|---|---|---|---|---|
| JP | 54069059 A | * | 6/1979 | H01J/29/32 |
| JP | 55-1012 | | 1/1980 | H01J/29/80 |
| JP | 2-195633 | | 8/1990 | H01J/29/62 |

* cited by examiner

*Primary Examiner*—Nimeshkumar D. Patel
*Assistant Examiner*—Sikha Roy
(74) *Attorney, Agent, or Firm*—Merchant & Gould P.C.

(57) ABSTRACT

A cathode ray tube includes a bulb including a front panel and a funnel, and an electron gun. The front panel includes a color selection mechanism and phosphors on an inner surface thereof. The funnel includes a conductive layer on an inner wall thereof. The electron gun is accommodated in a neck portion of the funnel. The conductive layer is divided into at least two regions, each of which has a different electric potential. A high electric potential conductive layer having a high electric potential, an insulating region, a resistive layer, and a low electric potential conductive layer having an electric potential lower than that of the high electric potential conductive layer are formed in this order from the panel side to the electron gun side. With this configuration, the two conductive layers do not interfere with each other because of discharge or the like and are independent, and stable voltage can be maintained. Thus, an electrostatic lens can be formed.

17 Claims, 4 Drawing Sheets

CATHODE RAY TUBE

BACKGROUND OF THE INVENTION

1. Field of the Invention

The present invention relates to a cathode ray tube used in television receivers, computer displays or the like that have a color selection mechanism such as a shadow mask.

2. Description of the Related Art

A conventional cathode ray tube will be described with reference to FIG. 4. A glass envelope includes a panel 4 for forming a screen, a funnel 6, and an electron gun 8 provided in a neck portion 6*a* of the funnel 6. A phosphor plane 1 formed of phosphors of three colors of red, green and blue and an aluminum layer 2 are formed on the inner surface of the panel 4. Further inside thereof, a shadow mask 3, which is a color selection mechanism, is provided at a predetermined distance from the inner surface of the panel 4. An internal conductive layer 5 is formed on the inner surface of the funnel 6, and a high voltage (about 30 kV) is applied to the conductive layer 5 from the outside through an anode button 9. This high voltage is applied to an electron gun 8 through the internal conductive layer 5, and also is applied to the shadow mask 3 and the phosphor plane 1. Thus, an equipotential space of the high voltage is formed from the electron gun 8 to the phosphor plane 1.

Next, the operation of the cathode ray tube will be described. Electron beams are released from the electron gun 8, and images are formed on the phosphor plane 1. A deflection yoke 12 provided in a portion between the funnel 6 and the neck portion 6*a* deflects the electron beams in horizontal and vertical directions. When the electromagnetically deflected electron beams leave the electromagnetic deflection region, the beams follow a straight trajectory and reach the shadow mask 3. Then, the electron beams pass through the apertures of the shadow mask 3, and impinge on the phosphors on the phosphor plane 1, so that the phosphors are excited for light emission. When scanning the periphery of the screen, the electron beams 15 are incident obliquely to the shadow mask 3 with an angle of θm.

In order to reduce the total length of the cathode ray tube, it is necessary to enlarge the deflection angle θ1, i.e., the incident angle θm to the shadow mask 3, in the conventional system. For this reason, significantly high precision is required for positioning the deflection yoke 12 when it is mounted.

Furthermore, since about 80% of the electron beams impinge on the shadow mask 3, a so-called doming phenomenon, which is a thermal expansion phenomenon, is caused, so that the displacement in the position of the apertures causes mislanding of the electron beams. The larger the incident angle θm is, i.e., the larger the deflection angle θ1 is, the larger is the possibility of even a small displacement of the aperture position causing a large mislanding. Also with respect to the influence of geomagnetism, a large angle θm causes more significant mislanding.

In order to solve these problems, the following approach has been proposed. A different desired electric potential is applied to at least a part of the electron gun and the funnel from that applied to the screen portion, so that an electrostatic lens is formed between the funnel and the screen portion, or a further electrostatic lens is formed between the electron gun and the funnel or in other portions. This configuration prevents the electron beams deflected by the deflection yoke from traveling along a straight trajectory when they leave the electromagnetic deflection region, and allows the electron beams be incident to the shadow mask at an angle θm smaller than the angle θ1. Such a configuration where an electrostatic lens is formed in the tube is disclosed in, for example, JP 55-1012 A. In this disclosure, instead of the conductive layer 5 being applied uniformly onto the inner wall of the funnel, a conductive layer made of graphite is applied independently to a plurality of regions, and different electric potentials (25 kV as a high electric potential and 12 kV or 17 kV as a low electric potential) are applied from region to region, so that electrostatic lenses are formed in the cathode ray tube.

However, in the above-described conventional configuration, the conductive layer is formed of porous graphite having a small specific resistance. Therefore, discharge tends to occur between the conductive layers having different electric potentials in a vacuum. In order to keep the electric potential of each of the conductive layers independent, it is necessary to enlarge the distance between the conductive layers. This leads to a large exposed area of the glass base material, so that problems such as the distortion of the electrostatic lens, discharge and charge drift are caused.

SUMMARY OF THE INVENTION

Therefore, with the foregoing in mind, it is an object of the present invention to provide a highly reliable cathode ray tube where there is no interference of at least two different electric potentials due to discharge or the like, and the electric potentials are kept independent and stable. A cathode ray tube of the present invention includes a bulb including a front panel and a funnel-shaped member (funnel), and an electron gun. The front panel includes a color selection mechanism and phosphors on an inner surface thereof. The funnel includes at least two conductive layers on an inner wall thereof. The electron gun is accommodated in a neck portion of the funnel. The conductive layers have different electric potentials from each other. The conductive layers include a high electric potential layer having a high electric potential and a low electric potential layer having an electric potential lower than that of the high electric potential layer. An insulating region is formed between the high and low electric potential layers. A resistive layer is further formed between the low electric potential layer and the insulating region.

This embodiment prevents at least two different electric potentials from interfering with each other because of discharge or the like in the cathode ray tube and allows the electric potentials to be independent, and the conductive layers can supply stable electric potentials. Thus, an electrostatic lens can be formed.

Alternatively, the resistive layer can occupy a region between the low electric potential layer and the high electric potential layer, instead of the insulating region being formed.

This embodiment prevents at least two different electric potentials from interfering with each other because of discharge or the like in the cathode ray tube and allows the electric potentials to be independent, and the conductive layers can supply stable electric potentials. Thus, an electrostatic lens can be formed. Furthermore, since the glass surface of the funnel is not exposed, the problem of charge drift can be solved.

Furthermore, it is preferable that the resistive layer and electron beams are insulated by an internal magnetic shield, and the internal magnetic shield has the same electric potential as that of either one of the panel or the funnel.

This embodiment prevents the glass surface of the funnel or the resistive layer in the cathode ray tube from being exposed to electron beams. Therefore, problems such as distortion of raster shape due to a coating shape of the region and charge drift can be solved.

These and other advantages of the present invention will become apparent to those skilled in the art upon reading and understanding the following detailed description with reference to the accompanying figures.

DESCRIPTION OF THE PREFERRED EMBODIMENTS

First Embodiment

Figure 1:
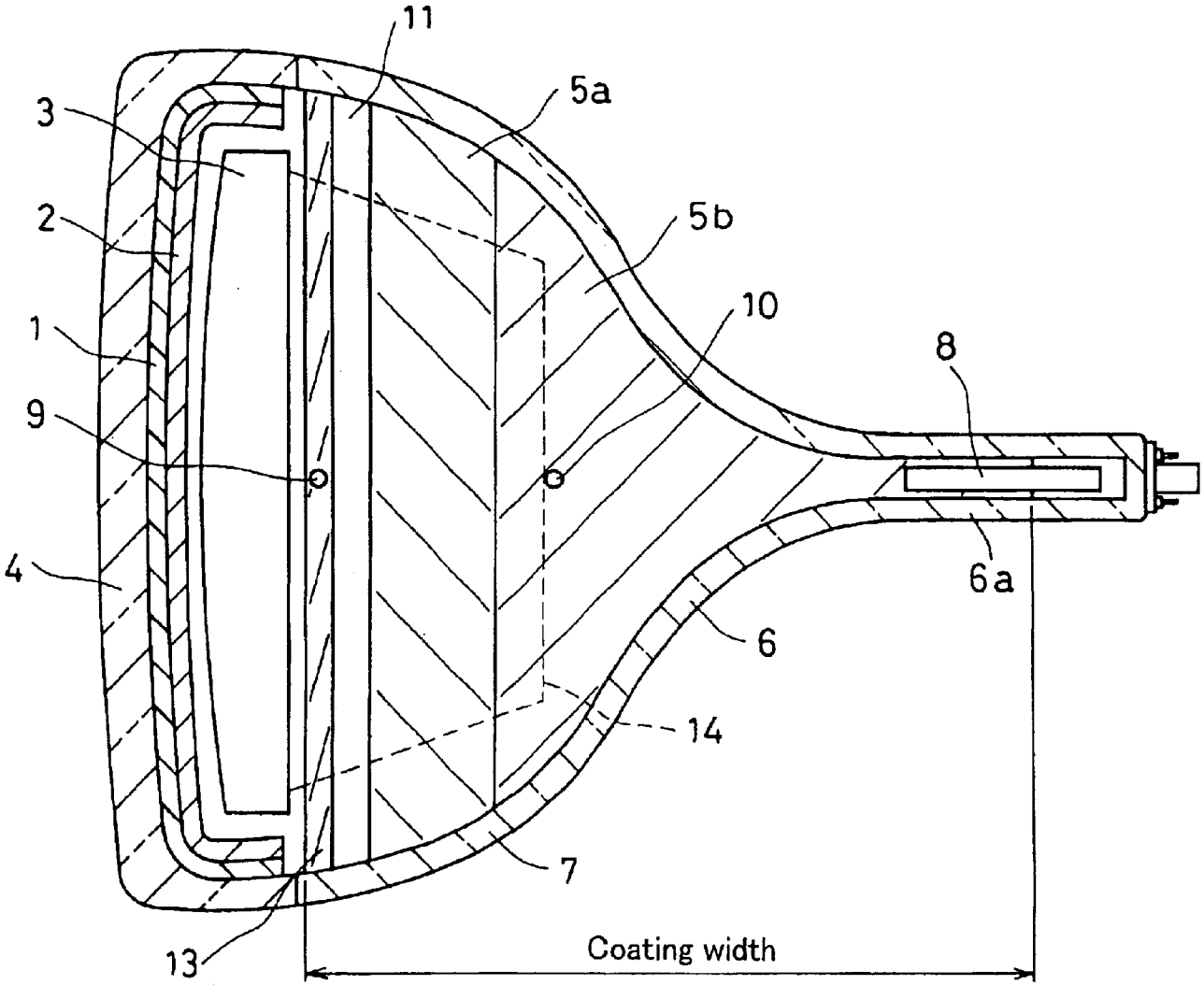
FIG. 1 is a cross-sectional side view of a first embodiment of the cathode ray tube of the present invention.

The cathode ray tube of the present invention shown in FIG. 1 includes a bulb 7 constituted by a panel 4 and a funnel 6, and an electron gun 8 for releasing electron beams. The panel 4 has a phosphor layer 1, an aluminum layer 2 and a shadow mask 3 on its inner surface. The electron gun 8 is accommodated in a neck portion 6*a* of the funnel 6. On the inner surface of the funnel 6, a conductive layer 13, which is a high electric potential electrode, is provided around the entire periphery of the end of the funnel 6 on the side of the panel 4. Then, a resistive layer 5*a* is formed beyond an insulating gap 11 where the glass surface of the funnel 6 is exposed. Further a conductive layer 5*b*, which is a low electric potential electrode, is formed adjacent to the resistive layer 5*a* on the funnel 6 on the side of the electron gun 8. A first anode button 9 is connected to the conductive layer 13, and a second anode button 10 is connected to the conductive layer 5*b*. The conductive layers 13 and 5*b* are maintained at predetermined electric potentials through the respective anode buttons. The shadow mask 3, which is a color selection mechanism, and an internal magnetic shield 14 fixed to the shadow mask 3 are provided inside the panel 4. The inner surface of the panel 4, the shadow mask 3 and the internal magnetic shield 14 are set at the same electric potential through panel pins (not shown) buried in the panel 4 and a plate-shaped spring (not shown) attached to the shadow mask 3. The internal magnetic shield 14 is formed by four general trapezoidal shaped electrode members that define a frustum-like three dimensional structure and insulates the resistive layer 5*a* from electron beams.

Hereinafter, an example where the present invention is applied to a cathode ray tube for a 46 cm (19 inches) computer monitor having an outer diameter ø of the neck portion of 29.1 mm will be described. In the following examples, the width of the layer refers to the length in the direction of the axis of the tube (the longitudinal direction in FIG. 1).

EXAMPLE 1

The conductive layer 13 having a width of 15 mm, which is a high electric potential electrode, was provided on the funnel 6 on the side of the panel 4 by applying Aquadag S manufactured by Acheson Japan Ltd. with a brush. The insulating gap 11 having a width of 20 mm was defined adjacent thereto. Adjacent to the insulating gap 11, resistive paste S-52073 (manufactured by Shoei Chemical Inc.) containing ruthenium oxide was applied in a width of 10 mm with a brush as the resistive layer 5*a*. Then, the funnel 6 was fired and solidified at predetermined temperatures so that the layers are adhered thereto. Then, conductive paste GA-354C (manufactured by Hitachi Powder Metallurgy Co., Ltd.) comprising graphite and titanium oxide was adhered to the remaining portion of the funnel 6 to form the conductive layer 5*b*. Thus, the layers on the inner surface of the funnel were formed.

COMPARATIVE EXAMPLE 1

In Comparative Example 1, a cathode ray tube was produced in the same manner as in Example 1, except that the resistive layer 5*a* was not provided, and conductive paste GA-354C was applied in that portion instead, and that the internal magnetic shield 14 was not used.

The samples of Example 1 and Comparative Example 1 were examined for interference of the electric potential applied to the panel with the low electric potential electrode of the funnel (i.e., the low electric potential conductive layer 5*b*) and charge drift. Interference was evaluated by applying a high voltage only to the panel 4 and the conductive layer 13 of the funnel 6, and measuring an induced voltage in the conductive layer 5*b* and observing a discharge phenomenon. Charge drift was evaluated by allowing the cathode ray tube to emit light for 60 minutes at a voltage ratio of a high electric potential:a low electric potential of 100:60 and measuring the average change in the landing points of electron beams at the four corners of the phosphor plane before and after the light emission of the cathode ray tube. Table 1 shows the results.

TABLE 1

| | Resistive layer | | Potential lower limit on the funnel low voltage side [kV] Voltage supplied to the panel [kV] | | | | |
|---|---|---|---|---|---|---|---|
| | Width [mm] | Mixture ratio titanium oxide: aluminum oxide | 10 | 20 | 30 | Discharge phenomenon | Charge drift (corner average) [μm] |
| Ex. 1 | 10 | — | 0 | 0 | 0 | Did not occur | 0 |
| Ex. 2 | 30 | — | 0 | 0 | 0 | Did not occur | 0.6 |
| Ex. 3 | 10 | 40:60 | 0 | 0 | 5.0 | Did not occur | 0.5 |

TABLE 1-continued

| | Resistive layer | | Potential lower limit on the funnel low voltage side [kV] Voltage supplied to the panel [kV] | | | | |
|---|---|---|---|---|---|---|---|
| | Width | Mixture ratio titanium oxide: | | | | Discharge | Charge drift (corner average) |
| | [mm] | aluminum oxide | 10 | 20 | 30 | phenomenon | [μm] |
| Ex. 4 | 10 | 7:93 | 0 | 0 | 4.0 | Did not occur | 0.2 |
| Com. Ex. 1 | 0 | — | 8.3 | 18.7 | 26.8 | Occurred | 75 |

According to Example 1, the induced voltage was 0V, i.e., 0% of the applied voltage, when 30 kV was applied to the panel, and there was no interference of the high voltage with the low voltage. Therefore, it is possible to set the electric potentials at the ratio of 100:0, thus leading to a high degree of freedom in the design of a desired electrostatic lens. On the other hand, in Comparative Example 1, where all the electrodes on the low electric potential side were formed of conductive paste, the induced voltage was 90% or more when 30 kV was applied to the panel, and there was significant interference of the high voltage with the low voltage. Thus, a desired effect of an electrostatic lens cannot be obtained.

The ruthenium oxide of this example generally has a molecular structure of $Ru_xO_y$, where x and y are arbitrary values. The resistive layer 5*a* also can be formed by dipping, printing or the like. In this example, two anode buttons are provided to supply the electric potential individually to each conductive layer, but the anode button may be one, and a dividing resistor may be provided in the tube so that desired partial voltages can be supplied.

EXAMPLE 2

A cathode ray tube was produced in the same manner as in Example 1, except that the width of ruthenium oxide applied as the resistive layer 5*a* was 30 mm. The induced voltage was 0V when 30 kV was applied to the panel, as shown in Table 1. There was no interference with the low electric potential, and the electric potentials can be set at a ratio of up to 100:0. Thus, the degree of freedom in the design of a desired electrostatic lens is high.

EXAMPLE 3

A cathode ray tube was produced in the same manner as in Example 1, except that the resistive layer 5*a* was formed by thermal spraying using a mixture of titanium oxide and aluminum oxide (a mixture ratio of 40:60) instead of ruthenium oxide. In this example, as shown in Table 1, the induced voltage was 5 kV, i.e., 17% of the applied voltage, when 30 kV was applied to the panel. The interference with the low electric potential was low, and the electric potentials can be set at a ratio of up to 100:0 (20 kV or less). Thus, the degree of freedom in the design of a desired electrostatic lens is high.

EXAMPLE 4

A cathode ray tube was produced in the same manner as in Example 1, except that the resistive layer 5*a* was formed by thermal spraying using a mixture of titanium oxide and aluminum oxide (a mixture ratio of 7:93) instead of ruthenium oxide. In this example, as shown in Table 1, the induced voltage was 4 kV, i.e., 13% of the applied voltage, when 30 kV was applied to the panel. The interference with the low electric potential was low, and when the applied voltage is 20 kV, the electric potentials can be set at a ratio of up to 100:0. Thus, the degree of freedom in the design of a desired electrostatic lens is high.

In the above examples, two electric potentials were formed to form an electrostatic lens in the cathode ray tube. However, three or more electric potentials are provided to form electrostatic lenses.

Second Embodiment

Figure 2:
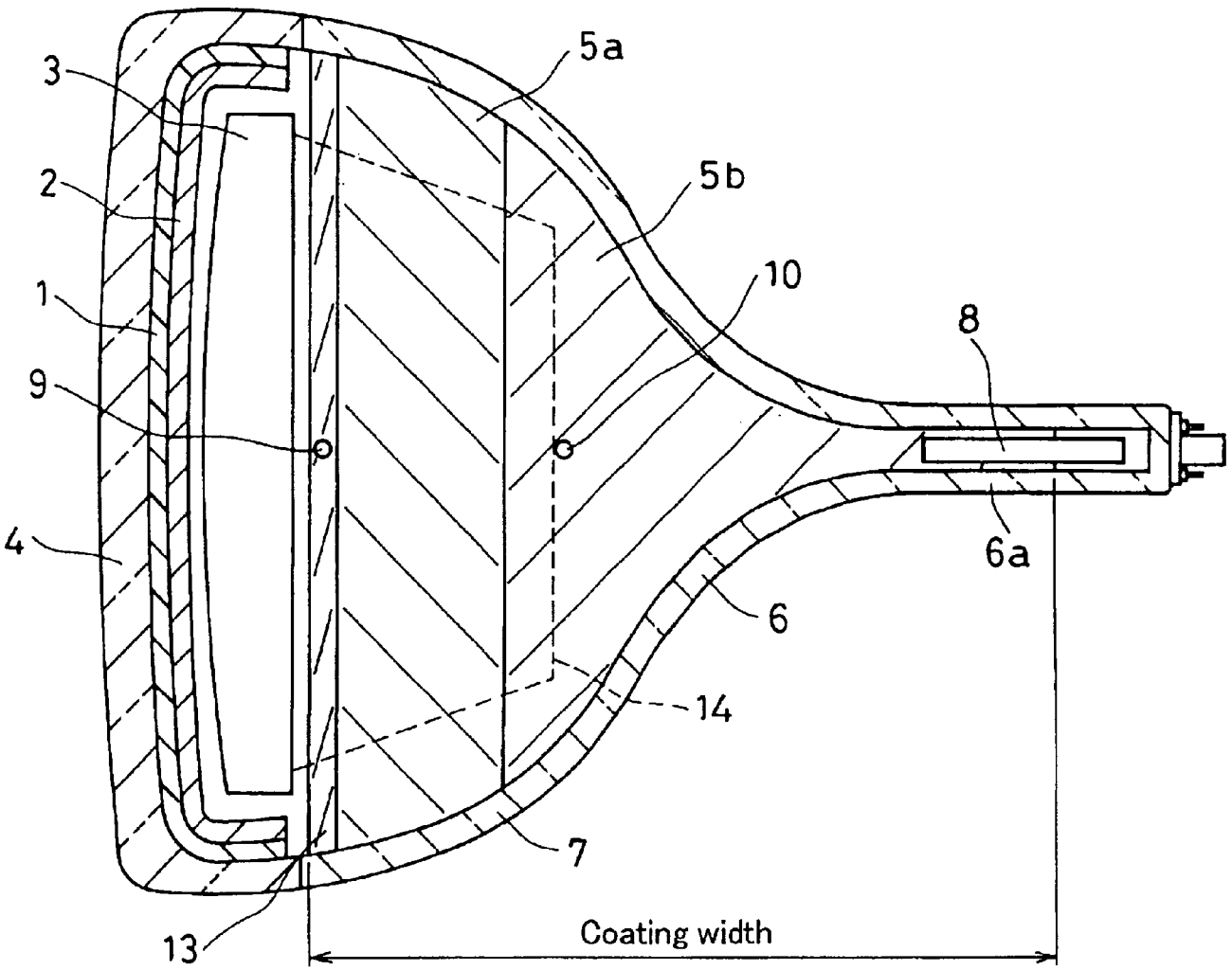
FIG. 2 is a cross-sectional side view of a second embodiment of the cathode ray tube of the present invention.

As shown in FIG. 2, a cathode ray tube of a second embodiment of the present invention includes a bulb 7 constituted by a panel 4 and a funnel 6, and an electron gun 8 for releasing electron beams. The panel 4 has a phosphor layer 1, an aluminum layer 2 and a shadow mask 3 on its inner surface. The electron gun 8 is accommodated in a neck portion 6*a* of the funnel 6. On the inner surface of the funnel 6, a conductive layer 13, which is a high electric potential electrode, is provided around the entire periphery of the end of the funnel 6 on the side of the panel 4. From this point toward the electron gun 8, a resistive layer 5*a* and a conductive layer 5*b*, which is a low electric potential electrode, are formed in this order adjacent to each other. The resistive layer 5*a* is formed of a mixture of aluminum oxide and titanium oxide. The resistive layer 5*a* connects the conductive layer 13, to which a first anode button 9 is connected, and the conductive layer 5*b*, to which a second anode button 10 is connected. An internal magnetic shield 14 is fixed to the shadow mask 3 in the same manner as in the first embodiment.

In this embodiment, current constantly flows via the resistive layer 5*a* between the two electrodes to which different voltages are applied (i.e., the conductive layers 13 and 5*b*). Therefore, the discharge phenomenon does not occur. In addition, since the resistive layer 5*a* has a high resistance, the current is as small as about several μA, so that a burden to the power supply such as voltage drop is small. Therefore, each electrode can supply an independent electric potential, which allows stabilization of the electrostatic lens and can reduce charge-up and spark failure between the electrodes. Thus, a highly reliable cathode ray tube can be provided.

Hereinafter, an example where the present invention is applied to a cathode ray tube for a 46 cm (19 inches) computer monitor having an outer diameter ø of the neck portion of 29.1 mm will be described.

EXAMPLE 5

The conductive layer 13 having a width of 20 mm was provided on the inner surface of the funnel 6 on the side of the panel 4 by applying Aquadag S manufactured by Acheson Japan Ltd. with a brush. A mixture of titanium oxide (comprising $TiO_2$ as the main component) and aluminum oxide (a mixture ratio of 10:90) having a width of 20 mm (equivalent to a connection resistance value of 700 MΩ) was adhered by plasma thermal spraying to form the resistive layer 5*a*. The conductive layer 5*b* was formed by adhering conductive paste GA-354C (manufactured by Hitachi Powder Metallurgy Co., Ltd.) comprising graphite and titanium oxide. Thus, the conductive layer 13, the resistive layer 5*a* and the conductive layer 5*b* were formed adjacent to one after another without a gap.

COMPARATIVE EXAMPLES 2 AND 3

In Comparative Example 2, a cathode ray tube was produced in the same manner as in Example 5, except that the mixture ratio of titanium oxide and aluminum oxide of the resistive layer 5*a* was changed to 30:70 and that the width thereof was changed to 10 mm (equivalent to a connection resistance value of 50 MΩ).

In Comparative Example 3, a cathode ray tube was produced in the same manner as in Example 5, except that the resistive layer 5*a* was not formed between the conductive layers 13 and 5*b*, and a region of a width of 40 mm where the glass base material was exposed is formed so that the connection resistance between the two conductive layers 13 and 5*b* was infinite.

The samples of Example 5 and Comparative Examples 2 and 3 were examined for interference of the electric potential applied to the panel with the low electric potential electrode of the funnel and charge drift in the same manner as in the first embodiment. Table 2 shows the results.

TABLE 2

| | Resistive layer | | | Potential lower limit on the funnel low voltage side [kV] Voltage supplied to the panel [kV] | | | | |
|---|---|---|---|---|---|---|---|---|
| | Width [mm] | Resistance [Ω] | Mixture ratio titanium oxide: aluminum oxide | 10 | 20 | 30 | Discharge phenomenon | Charge drift (corner average) [μm] |
| Ex. 5 | 20 | 700 M | 10:90 | 0.2 | 1.7 | 2.9 | Did not occur | 1.0 |
| Ex. 6 | 50 | 17 G | 7:93 | 0.1 | 1.3 | 2.5 | Did not occur | 1.4 |
| Ex. 7 | 150 | 1 G | 20:80 | 0.2 | 1.6 | 2.7 | Did not occur | 3 |
| Ex. 8 | 150 | 500 G | 7:93 | 0.1 | 1.2 | 2.3 | Did not occur | 2 |
| Ex. 9 | 150 | 2 G | 7:93 | 0.1 | 1.2 | 2.3 | Did not occur | 2 |
| Com. Ex. 2 | 10 | 50 M | 30:70 | 8.0 | 18.0 | 27.3 | Occurred | — |
| Com. Ex. 3 | 40 | ∞ | — | 7.8 | 17.2 | 27.7 | Occurred | — |

According to Example 5, the induced voltage was not more than 10% when 30 kV was applied to the panel. The interference with the low electric potential is low, namely, the electric potentials can be set at a ratio of 100:10. Furthermore, since current on the order of several μA flows, there is no electric charge, and discharge does not occur. In Comparative Example 2 where the width of the resistive layer applied is smaller, the connection resistance is as low as 50 MΩ. Therefore, the induced voltage was 80% or more when up to 30 kV was applied. The interference with the low electric potential is large, so that effects of a desired electrostatic lens cannot be obtained. Furthermore, in Comparative Example 3 where the width of the exposed glass is 40 mm, the induced voltage is large due to the discharge phenomenon across the gap, and the electrostatic lens cannot be formed by the electric potential difference. As described above, Example 5, where the resistance value of the resistive layer formed of aluminum oxide and titanium oxide is 700 MΩ or more, provides a high degree of freedom in the design.

The conductive layer 5*b* can be formed using a material comprising graphite having a small specific resistance and titanium oxide as the main component.

EXAMPLE 6

A cathode ray tube was produced in the same manner as in Example 5, except that the mixture ratio of titanium oxide and aluminum oxide of the resistive layer 5*a* was changed to 7:93, and that the width of the resistive layer 5*a* applied was 50 mm (equivalent to 17 GΩ). In this example, the induced voltage was not more than 10% when up to 30 kV was applied to the panel. The interference with the low electric potential was low, and the electric potentials can be set at a ratio of 100:10. Thus, the degree of freedom in the design of a desired electrostatic lens is high.

EXAMPLE 7

A cathode ray tube for a 91 cm (38 inches) TV was produced in the same manner as in Example 5, except that the mixture ratio of titanium oxide and aluminum oxide of the resistive layer 5*a* was changed to 20:80, and that the width of the resistive layer 5*a* applied was 150 mm (equivalent to 1 GΩ). In this example, the induced voltage was not more than 10% when up to 30 kV was applied to the panel. The interference with the low electric potential was low, namely, the electric potentials can be set at a ratio of 100:10. Thus, the degree of freedom in the design of a desired electrostatic lens is high.

EXAMPLE 8

A cathode ray tube for a 76 cm (32 inches) TV was produced in the same manner as in Example 5, except that the mixture ratio of titanium oxide and aluminum oxide of the resistive layer 5*a* was changed to 7:93, and that the width of the resistive layer 5*a* applied was 150 mm (equivalent to 500 GΩ). In this example, the induced voltage was not more than 10% when up to 30 kV was applied to the panel. The interference with the low electric potential was low, namely, the electric potentials can be set at a ratio of 100:10. Thus, the degree of freedom in the design of a desired electrostatic lens is high.

EXAMPLE 9

A cathode ray tube for a 76 cm (32 inches) TV was produced in the same manner as in Example 5, except that the mixture ratio of titanium oxide (comprising TiO as the main component) and aluminum oxide of the resistive layer 5*a* was changed to 7:93, and that the width of the resistive layer 5*a* applied was 150 mm (equivalent to 2 GΩ). In this example, the induced voltage was not more than 10% when up to 30 kV was applied to the panel. The interference with the low electric potential was low, namely, the electric potentials can be set at a ratio of 100:10. Thus, the degree of freedom in the design of a desired electrostatic lens is high.

The aluminum oxide used in the above example generally has a molecular structure of $Al_xO_y$ where x and y are arbitrary values. The titanium oxide generally has a molecular structure of $Ti_xO_y$, where x and y are arbitrary values. The aluminum oxide and the titanium oxide are formed by coating with a thermal spraying method. However, they can be formed by dipping, printing or the like. In the above examples, two anode buttons are provided to supply an electric potential to each conductive layer individually, but the anode button may be one, and a dividing resistor may be provided in the tube so that desired partial voltages can be supplied.

A desirable method for supplying the voltage is as follows: A high electric potential layer is supplied with a voltage from a flyback transformer, and a low electric potential layer is supplied with a voltage from a given point in winding of the core of the flyback transformer. This is preferable because if a high voltage and a low voltage are supplied from separate flyback transformers, the voltages supplied from the transformers may become unstable because of the influence of voltage drop caused by electron beam current flowing. Furthermore, if a high voltage and a low voltage are changed separately and independently, the intensity of the effect of the electrostatic lens caused by the difference in the electric potential is changed over time, which may cause changes in the raster size or convergence and thus adversely influence displayed images.

Figure 3:
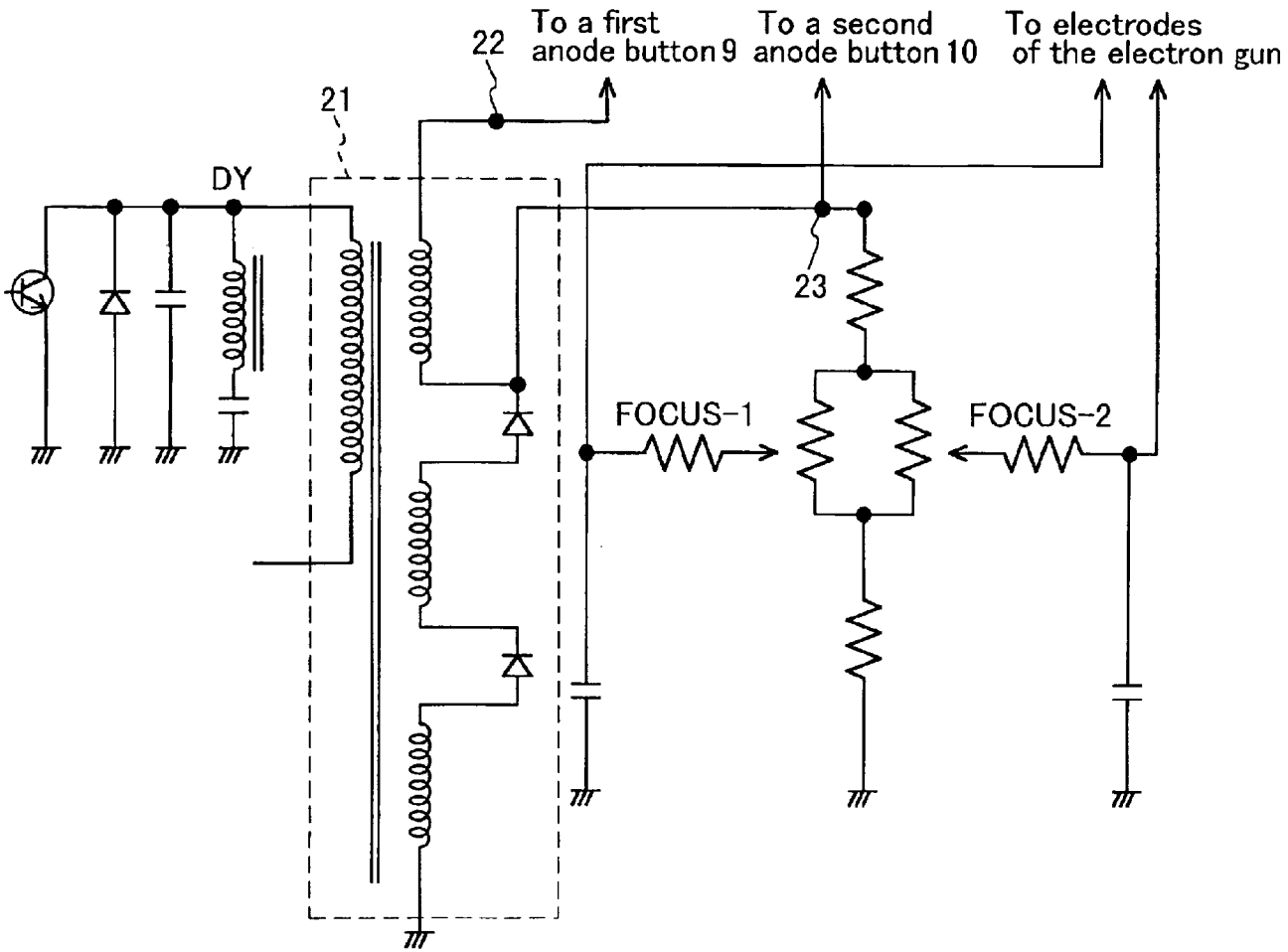
FIG. 3 is a diagram of a circuit for supplying voltage to the cathode ray tube of the present invention.
Figure 4:
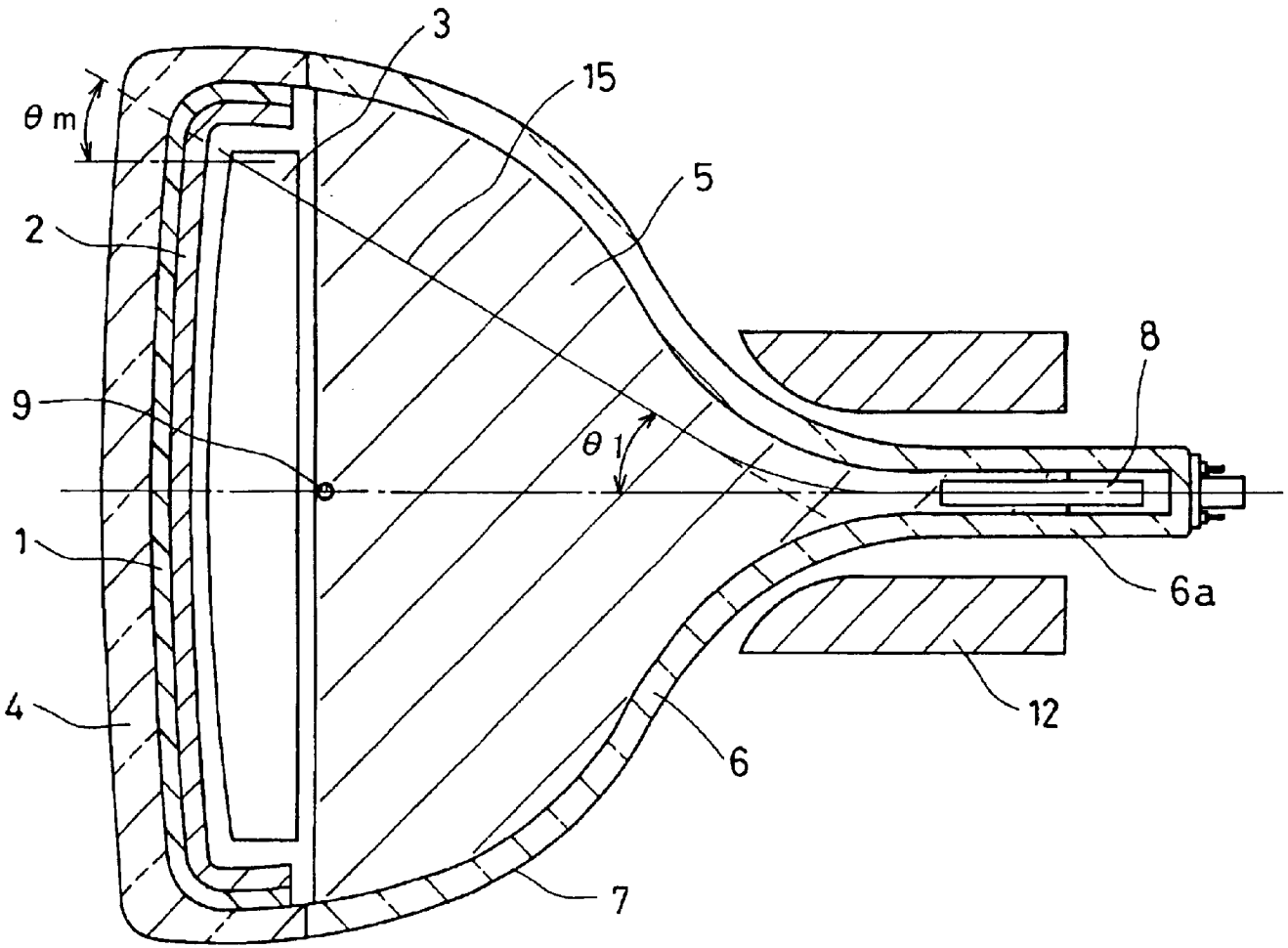
FIG. 4 PRIOR ART
FIG. 4 is a cross-sectional side view of a conventional cathode ray tube.

FIG. 3 shows a circuit for supplying high voltage to the cathode ray tube. As shown in FIG. 3, the secondary coil of the flyback transformer 21 having a first terminal 22 for supplying high voltage is divided into a plurality of (three in FIG. 3) coils, and a second terminal 23 is formed to obtain a voltage lower than the high voltage from a point between the coils. With this configuration, the voltage is changed while keeping the voltage ratio of the high voltage to the lower voltage substantially constant. Therefore, the change in the intensity of the electrostatic lens caused by the difference in the potential can be minimized, so that the adverse effect can be restricted to an allowable range for practical use.

Furthermore, two focus voltages (FOCUS-1 and FOCUS-2) can be supplied by dividing the resistive potential from the second terminal 23, so that the ratio of the final acceleration voltage supplied from the second terminal 23 to each of the two focus voltages can be kept constant. Thus, focus adjustment or the like can be performed satisfactorily.

In the cathode ray tube of the present invention, there is no limitation regarding the value of voltage applied to each of the high and low electric potential layers. However, generally, a voltage of about 30 kV can be applied to the high electric potential layer, and a voltage of about 26 kV can be applied to the low electric potential layer.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode ray tube comprising a bulb including a front panel and a funnel, and an electron gun, the front panel including a color selection mechanism and phosphors on an inner surface thereof, the funnel having a neck portion and a non-neck portion, the funnel including at least two conductive layers on an inner wall thereof, with at least a portion of each of the at least two conductive layers being in the non-neck portion of the funnel, the electron gun being accommodated in a neck portion of the funnel, the conductive layers having different electric potentials from each other, wherein the conductive layers include a high electric potential layer having a high electric potential and a low electric potential layer having an electric potential lower than that of the high electric potential layer, an insulating region is formed between the high electric potential layer and the low electric potential layer, a resistive layer is further formed between the low electric potential layer and the insulating region, and an electrostatic lens is formed in the funnel by the electric potential difference between the high electric potential layer and the low electric potential layer.

2. The cathode ray tube according to claim 1, wherein the resistive layer comprises ruthenium oxide.

3. The cathode ray tube according to claim 1, wherein the resistive layer comprises a mixture of titanium oxide and aluminum oxide.

4. The cathode ray tube according to claim 3, wherein a mixture ratio of the titanium oxide to the aluminum oxide is 7:93 to 40:60.

5. The cathode ray tube according to claim 1, wherein a width of the resistive layer is not less than 10 mm.

6. The cathode ray tube according to claim 1, wherein the resistive layer and electron beams are insulated by an internal magnetic shield, and the internal magnetic shield has a same electric potential as that of either one of the panel or the funnel.

7. The cathode ray tube according to claim 1, wherein the high electric potential layer is supplied with a voltage from a flyback transformer, and the low electric potential layer is supplied with a voltage from a given point in winding of a core of the flyback transformer.

8. A cathode ray tube comprising a bulb including a front panel and a funnel, and an electron gun, the front panel including a color selection mechanism and phosphors on an inner surface thereof, the funnel having a neck portion and a non-neck portion, the funnel including at least two conductive layers on an inner wall thereof, with at least a portion of each of the at least two conductive layers being in the non-neck portion of the funnel, the electron gun being accommodated in a neck portion of the funnel, the conductive layers having different electric potentials from each other, wherein the conductive layers include a high electric potential layer having a high electric potential and a low electric potential layer having an electric potential lower than that of the high electric potential layer, a resistive layer occupies a region between the low electric potential layer and the high electric potential layer, and current constantly flows in the region between the low electric potential layer and the high electric potential layer to keep an electric potential difference, and by the electric difference, an electrostatic lens is formed in the funnel.

9. The cathode ray tube according to claim 8, wherein the resistive layer comprises a mixture of titanium oxide and aluminum oxide.

10. The cathode ray tube according to claim 9, wherein a mixture ratio of the titanium oxide to the aluminum oxide of the resistive layer is 7:93 to 20:80.

11. The cathode ray tube according to claim 8, wherein a connection resistance value of the resistance layer is not less than 700 MΩ and not more than 500 GΩ.

12. The cathode ray tube according to claim 8, wherein the resistive layer and electron beams are insulated by an internal magnetic shield, and the internal magnetic shield has a same electric potential as that of either one of the panel or the funnel.

13. The cathode ray tube according to claim 8, wherein the high electric potential layer is supplied with a voltage from a flyback transformer, and the low electric potential layer is supplied with a voltage from a given point in winding of a core of the flyback transformer.

14. The cathode ray tube according to claim 1, further comprising a first anode button connected to the high electric potential layer, which is maintained at a high electric potential, and a second anode button is connected to the low electric potential layer, which is maintained at a low electric potential.

15. The cathode ray tube according to claim 1, wherein when a deflection yoke is attached to the funnel, the resistive layer and the insulating region are formed so that they are located on a front panel side with respect to the deflection yoke.

16. The cathode ray tube according to claim 8, wherein when a deflection toke is attached to the funnel, the resistive layer is formed so that it is located on a front panel side with respect to the deflection yoke.

17. The cathode ray tube according to claim 1, wherein the insulating region is a portion where the glass surface of the funnel between the high electric potential layer and the low electric potential layer is exposed.

* * * * *